US009605437B2

(12) United States Patent
Cheng

(10) Patent No.: US 9,605,437 B2
(45) Date of Patent: Mar. 28, 2017

(54) DISMOUNTABLE FLOORING BLOCK

(71) Applicant: Yu-Yung Cheng, Tainan (TW)

(72) Inventor: Yu-Yung Cheng, Tainan (TW)

( * ) Notice: Subject to any disclaimer, the term of this patent is extended or adjusted under 35 U.S.C. 154(b) by 0 days.

(21) Appl. No.: 15/051,498

(22) Filed: Feb. 23, 2016

(65) Prior Publication Data

US 2016/0244978 A1 Aug. 25, 2016

(30) Foreign Application Priority Data

Feb. 25, 2015 (TW) ..... 104202896 U

(51) Int. Cl.
*E04F 15/02* (2006.01)

(52) U.S. Cl.
CPC .. *E04F 15/02133* (2013.01); *E04F 15/02038* (2013.01); *E04F 2201/0146* (2013.01); *E04F 2201/021* (2013.01); *E04F 2201/026* (2013.01); *E04F 2201/0511* (2013.01); *E04F 2201/0535* (2013.01); *E04F 2201/08* (2013.01); *E04F 2201/098* (2013.01)

(58) Field of Classification Search
CPC ..... E04F 15/02133; E04F 15/02038
USPC ..... 52/582.2, 578, 582.1
See application file for complete search history.

(56) References Cited

U.S. PATENT DOCUMENTS 5,247,773 A * 9/1993 Weir ..... E01F 8/0011 403/381
8,074,418 B2 * 12/2011 Thiagarajan ..... E04C 2/543 403/290
2007/0130872 A1 * 6/2007 Goodwin ..... E04F 15/02 52/592.1
2010/0083603 A1 * 4/2010 Goodwin ..... E04F 15/02 52/589.1
2011/0247285 A1 * 10/2011 Wybo ..... B29C 47/0019 52/309.1
2012/0124932 A1 * 5/2012 Schulte ..... E04F 15/02 52/588.1
2012/0279158 A1 * 11/2012 Konstanczak ..... E04F 13/0894 52/582.1

(Continued)

FOREIGN PATENT DOCUMENTS

DE 2251762 A1 * 5/1974 ..... E04F 15/022
DE 20215223 U1 * 2/2003 ..... E04F 15/02

OTHER PUBLICATIONS

Extended Search Report and Written Opinion for related EPO application No. 16156738 dated Aug. 24, 2016 (7 pages).*

*Primary Examiner* — Rodney Mintz
(74) *Attorney, Agent, or Firm* — Maschoff Brennan

(57) ABSTRACT

A dismountable flooring block comprises a flooring block body, having a first mounting edge portion and a second mounting edge portion, the first mounting edge portion and the second mounting edge portion being thinner than the flooring block body and being laterally extended from the flooring block body. Two mounting members are respectively disposed on an upper surface of the first mounting edge portion and on a bottom surface of the second mounting edge portion, in which a mounting direction of the first mounting edge portion and a mounting direction of the second mounting edge portion are both parallel to an up-and-down direction of the flooring block body, thereby enabling the mounting member of the flooring block body to mount to a mounting member of another flooring block body.

6 Claims, 6 Drawing Sheets

(56) References Cited

U.S. PATENT DOCUMENTS

2014/0033633 A1* 2/2014 Kell ..... E04F 15/02033
52/588.1

* cited by examiner

DISMOUNTABLE FLOORING BLOCK

FIELD OF THE INVENTION

The present invention relates to a flooring block, and more particularly relates to a dismountable flooring block.

BACKGROUND OF THE INVENTION

Puzzle flooring, as is implied in its name, is a kind of flooring which is assembled by a plurality of components, i.e. the flooring blocks, via which the installation of the flooring is convenient. In a puzzle flooring, one flooring block includes a mortise element at one side which corresponds to a tenon element at one side of another flooring block adjacent to said one flooring block. Via the mortise-and-tenon joint between two adjacent flooring blocks, a plurality of flooring blocks are able to be assembled to form a whole flooring that can be laid on the floor inside a building or on the ground outside.

However, in the prior art, the flooring blocks are designed with consideration of easy assembly only. Under the circumstances when the flooring blocks need to be dismantled, such as when the flooring blocks need replacement or rearrangement or when a wrong installation of the flooring blocks needs to be adjusted, it is found to have a drawback that a prior art flooring block cannot be individually dismounted. Instead, dismantling a single flooring block would involve dismantling the adjacent flooring blocks as well, or even dismantling the whole flooring.

SUMMARY OF THE INVENTION

Accordingly, prior flooring blocks are not designed with consideration of easy dismantlement. Therefore, when there are only a portion of flooring blocks to be dismantled, it is often that the adjacent flooring blocks that need not to be dismantled would unavoidable to be dismantled as well, or even the whole flooring will need to be dismantled, which causes huge inconvenience.

Consequently, one of the objects of the present invention is to provide a flooring block which has the advantages of easy assembly and easy dismantlement.

In order to overcome the technical problems in prior art, the present invention provides a dismountable flooring block, comprising a flooring block body, having a first mounting edge portion and a second mounting edge portion, the first mounting edge portion and the second mounting edge portion being thinner than the flooring block body and being laterally extended from the flooring block body; and two mounting members, respectively disposed on an upper surface of the first mounting edge portion and on a bottom surface of the second mounting edge portion, in which a mounting direction of the first mounting edge portion and a mounting direction of the second mounting edge portion are both parallel to an up-and-down direction of the flooring block body, thereby enabling the mounting member of the flooring block body to mount to a mounting member of another flooring block body, wherein the first mounting edge portion of the flooring block body overlaps in the mounting direction a second mounting edge portion of another flooring block body which is neighboring to the first mounting edge portion of flooring block body in such a manner that the first mounting edge portion of the flooring block body is mounted to the second mounting edge portion of said another flooring block such that the flooring block body is mounted to said another flooring block.

According to one embodiment of the present invention, the first mounting edge portion and the second mounting edge portion are provided on opposite sides of the flooring block body.

According to one embodiment of the present invention, the mounting member of the first mounting edge portion includes a protrusive bar extending in a direction along the first mounting edge portion, and the mounting member of the second mounting edge portion includes a concave bar, and by means of inserting the protrusive bar of the flooring block into the concave bar, the mounting member of the first mounting edge portion is mounted to the mounting member of the second mounting edge portion of another flooring block body.

According to one embodiment of the present invention, the mounting member of the first mounting edge portion includes a concave bar extended along the first mounting edge portion, and the mounting member of the second mounting edge portion includes a protrusive bar, and by means of inserting the protrusive bar into the concave groove, the mounting member of the first mounting edge portion is mounted to the mounting member of the mounting edge portion of said another flooring block body.

According to one embodiment of the present invention, the first mounting edge portion or the second mounting edge portion of the flooring board block includes a concave-convex structure on which the mounting member is disposed.

According to one embodiment of the present invention, the first mounting edge portion or the second mounting edge portion of the flooring board block includes a concave-convex structure on which the mounting member is disposed, and the second mounting edge portion or a first mounting edge portion of said another flooring block body includes a complementary concave-convex structure that matches the concave-convex structure.

Via the technical means adopted by the present invention, the flooring block of the present invention can be mounted with or be dismounted from an adjacent flooring block by applying a force from up to down or from down to up. Thus, as compared with the flooring blocks of prior art, which requires consideration of enough space for allowing flooring blocks to slide in or slide out when installing the flooring, the flooring blocks of the present invention are free from this restriction since they can be mounted to and dismounted from one another conveniently in the up-and-down direction. On the other hand, a flooring block of the present invention can be mounted to and dismounted from another adjacent flooring block without having to adjust the positions of other flooring blocks. By this structural means, the replacement, rearrangement, and positions adjustments of the flooring block of the present invention can be processed quickly and simply.

DETAILED DESCRIPTION OF THE PREFERRED EMBODIMENTS

The preferred embodiments of the present invention are described below with reference to FIG. 1 to FIG. 5. The description is only for explaining the preferred embodiments of the present invention, but not for limiting the implementation of the present invention.

Figure 1:
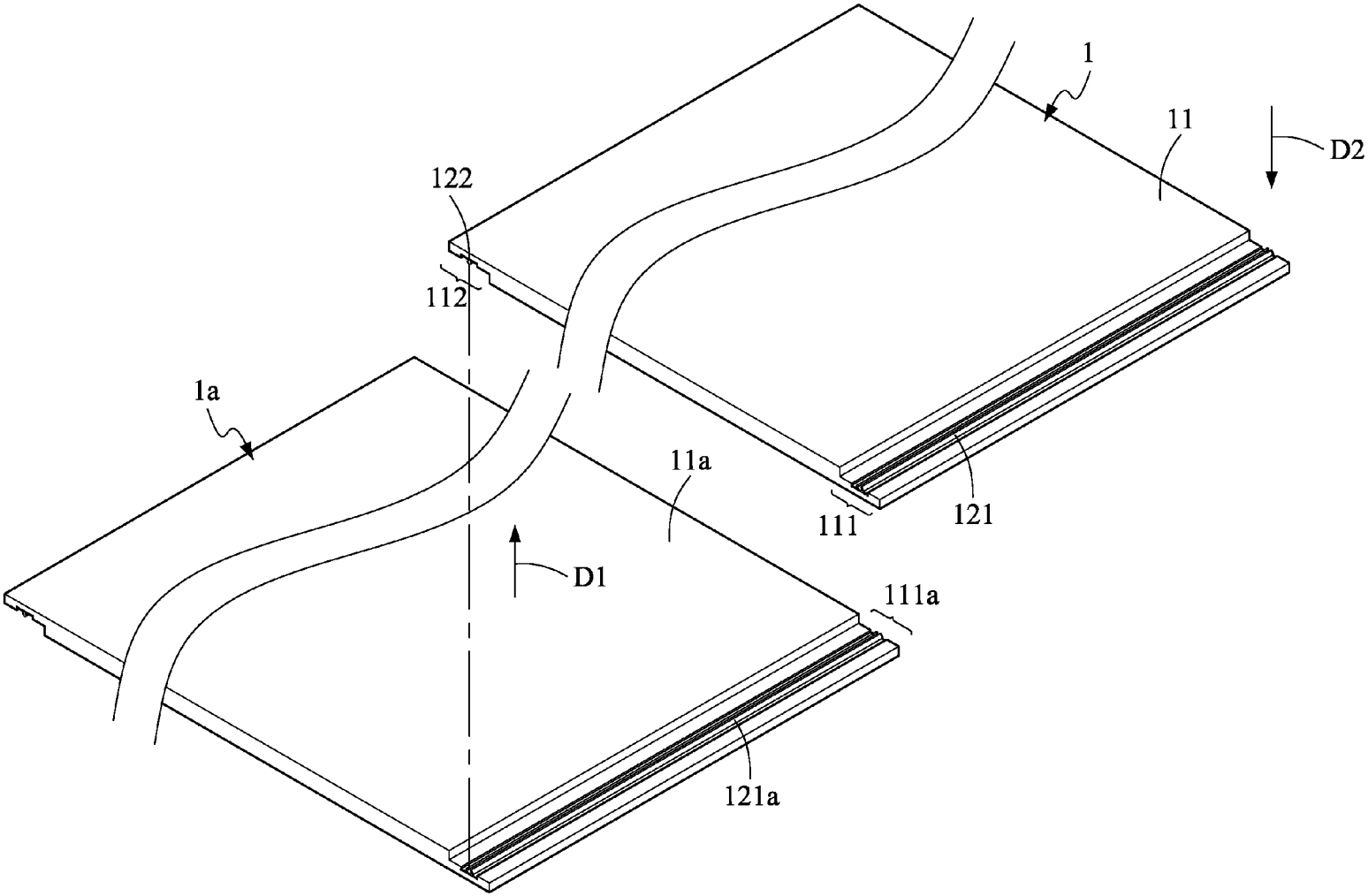
FIG. 1 is a stereogram illustrating a flooring block being mounted to another adjacent flooring block according to one embodiment of the present invention.
Figure 2:
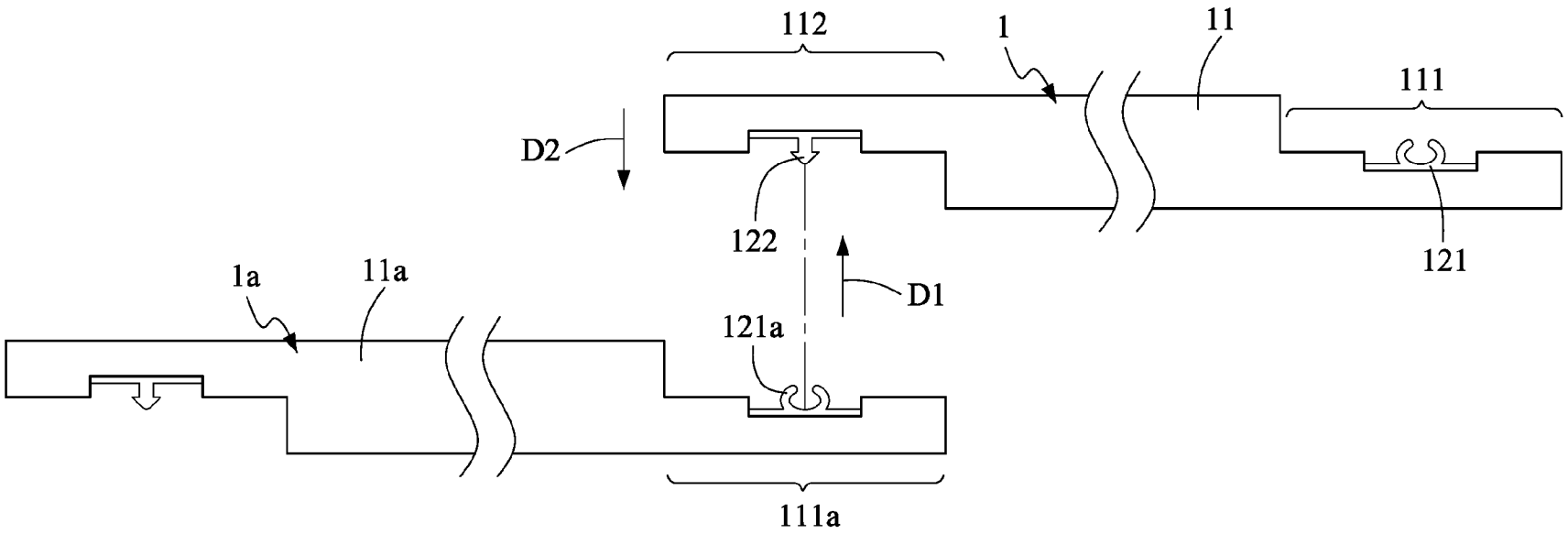
FIG. 2 is a side view illustrating the flooring block being mounted to another adjacent flooring block according to the embodiment of the present invention.
Figure 3:
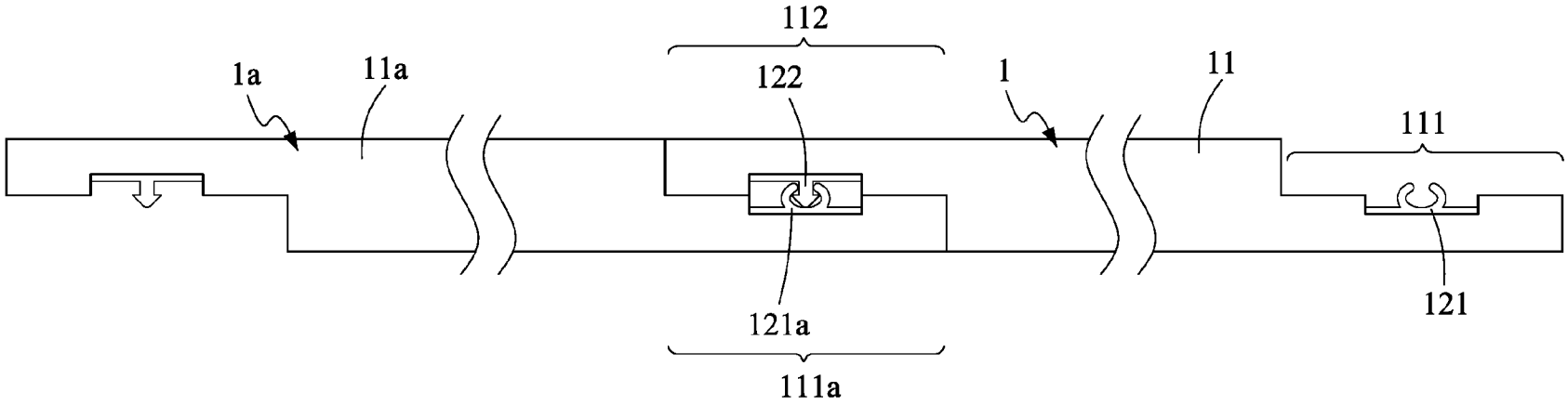
FIG. 3 is a side view of the flooring block mounted to another adjacent flooring block according to the embodiment of the present invention.

As shown in FIG. 1 to FIG. 3, a flooring block 1 according to one embodiment of the present invention includes: a flooring block body 11 having a first mounting edge portion 111 and a second mounting edge portion 112, the first mounting edge portion 111 and the second mounting edge portion 112 being thinner than the flooring block body 11 and being laterally extended from the flooring block body 11, and two mounting members 121, 122 respectively disposed on an upper surface of the first mounting edge portion 111 and on a bottom surface of the second mounting edge portion 112, and a mounting direction of the first mounting edge portion D1 and a mounting direction of the second mounting edge portion D2 are both parallel to an up-and-down direction of the flooring block body 11, thereby enabling the mounting member of the flooring block body to mount to a mounting member of another adjacent flooring block body, wherein the first mounting edge portion 111 of the flooring block body 11 overlaps in the mounting direction a second mounting edge portion 112*a* of another adjacent flooring block body 11*a* which is neighboring to the first mounting edge portion 111 of the flooring block body 11 in such a manner that the first mounting edge portion 111 of the flooring block body 11 is mounted to the second mounting edge portion 112*a* of said another adjacent flooring block 11*a* such that the flooring block body 11 is mounted to said another adjacent flooring block 11*a*.

As shown in FIG. 1 to FIG. 3, the flooring block body 11 is a rectangular block. In other embodiments, the flooring block body can be in a trapezoid shape, circle shape, or any other shapes. The flooring block body 11 includes a first mounting edge portion 111 and a second mounting edge portion 112 being laterally extended from the flooring block body 11, whose thicknesses are thinner than the flooring block body 11. In this embodiment, the first mounting edge portion 111 and the second mounting edge portion 112 being thinner than the flooring block body 11 refers to the thicknesses of the first mounting edge portion 111 and the second mounting edge portion 112 being smaller than the thickness of the flooring block body 11. Preferably, the thickness of the first mounting edge portion 111 is slightly smaller than a half of the thickness of the second mounting edge portion 112, by which the first mounting edge portion 111 and the second mounting edge portion 112 form a total thickness which is equal to that of the flooring block body 11 after the first mounting edge portion 111 is mounted on the second mounting edge portion 112. That is to say, the flooring block bodies 11, 11*a* form a constant thickness after they are mounted together.

Figure 4A:
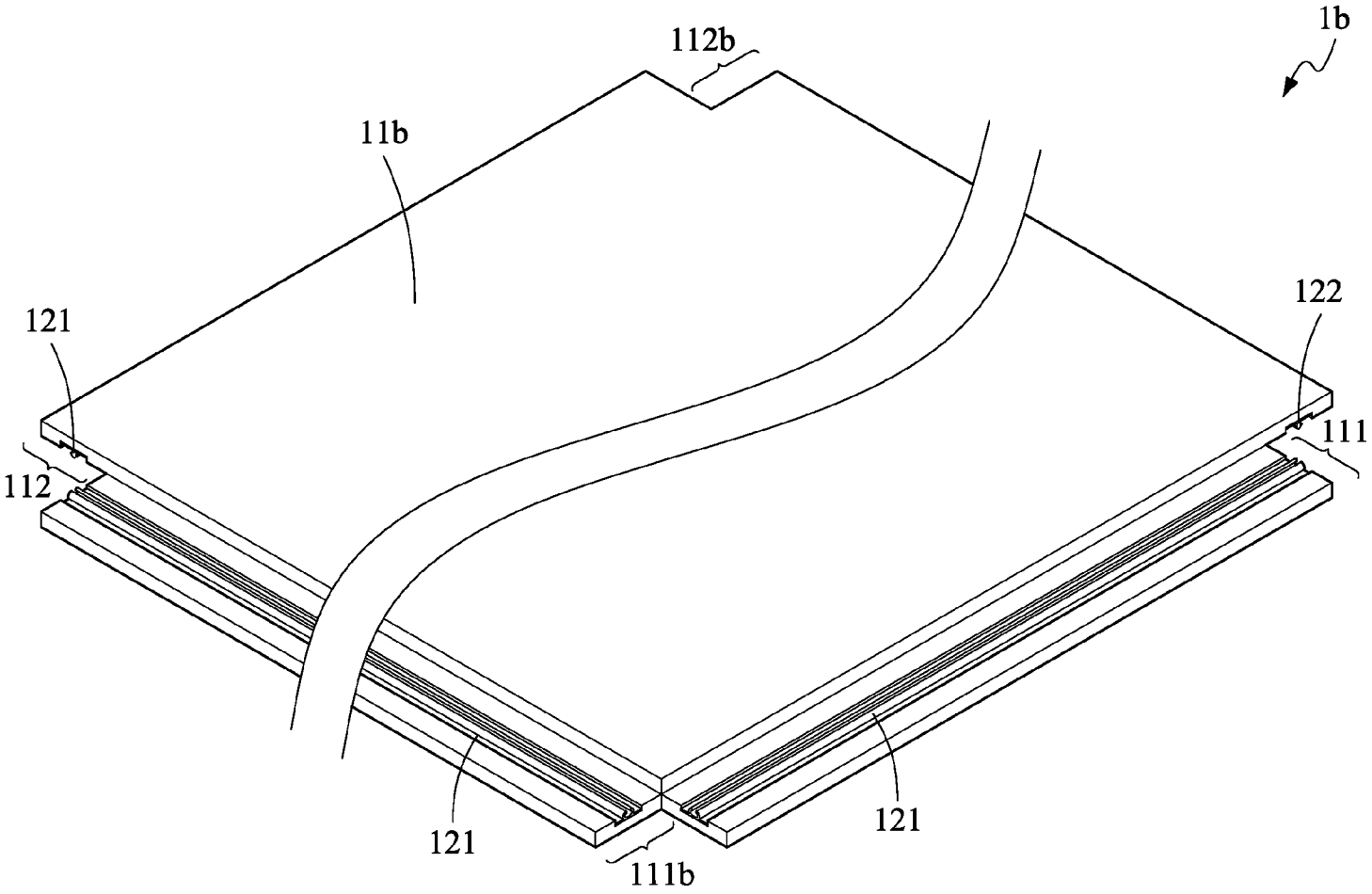
FIG. 4*a* is a stereogram illustrating a flooring block according another embodiment of the present invention.
Figure 4B:
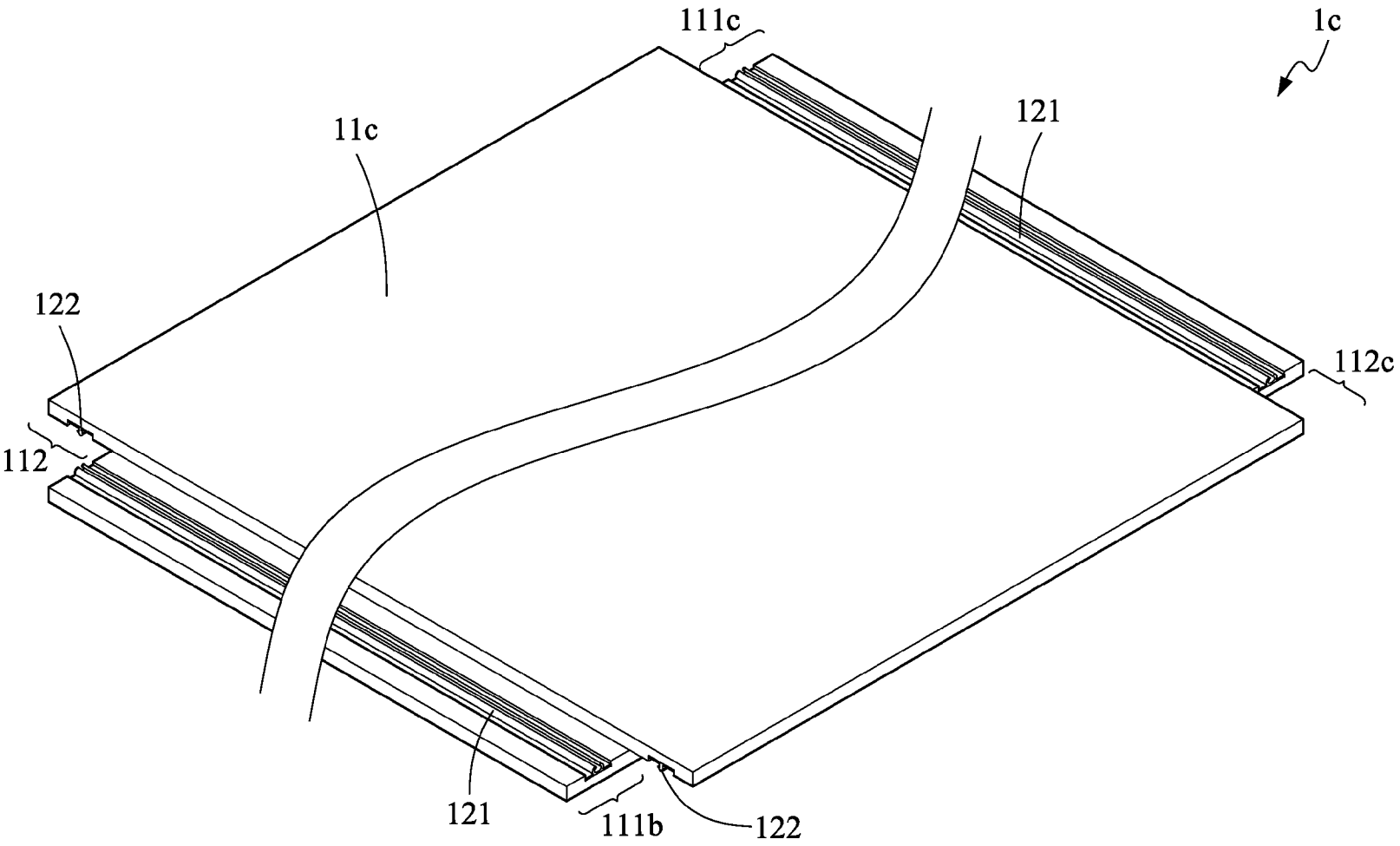
FIG. 4*b* is a stereogram illustrating the flooring block according another embodiment of the present invention.

Furthermore, in this embodiment, the first mounting edge portion 111 and the second mounting edge portion 112 extend laterally from the flooring block body 11 by having the thickness of the first mounting edge portion 111 and the thickness of the second mounting edge portion 112 thinner than the thickness of the flooring block body 11, in which the bottom surface of the first mounting edge portion 111 shares the same plane with the bottom surface of the flooring block body 11, and the upper surface of the second mounting edge portion 112 shares the same plane with the bottom surface of the flooring block body 11. The upper surface of the first mounting edge portion 111 and the bottom surface of the second mounting edge portion 112 are respectively provided with a recessive portion on which the mounting portion of the first mounting edge portion 121 and the mounting portion of the second mounting edge portion 122 are disposed. Certainly, the present invention is not limited to this. The number of the first mounting edge portion and the second mounting edge portion can be larger than one, and the positions of the first mounting edge portion and the second mounting edge portion are not limited to that described above. As shown in FIG. 4 which illustrates another embodiment of the present invention, a dismountable flooring block 1*a* includes a flooring block body 11*b* including four mounting edge portions 111, 111*b*, 112, 112*b*, wherein the first mounting edge portions 111, 111*b* extend laterally from the flooring block body 11*b* by having the thickness of the first mounting edge portion 111, 111*b* and the thickness of the second mounting edge portion 112, 112*b* thinner than the thickness of the flooring block body 11*b*, in which the bottom surface of the first mounting edge portion 111, 111*b* shares the same plane with the bottom surface of the flooring block body 11*b*, and the upper surface of the second mounting edge portion 112, 112*b* shares the same plane with the bottom surface of the flooring block body 11*b*. Alternatively, as shown in FIG. 4*b* which illustrates another embodiment of the present invention, a dismountable flooring block 1*c* comprises a flooring block body 11*c* including four mounting edge portions 111*b*, 111*c*, 112, 112*c* wherein the first mounting edge portion 111*b*, 111*c* extend laterally from the flooring block body 11*c* by having the thickness of the first mounting edge portion 111*b*, 111*c* and the thickness of the second mounting edge portion 112, 112*c* thinner than the thickness of the flooring block body 11, in which the bottom surface of the first mounting edge portion 111*b*, 111*c* shares the same plane with the bottom surface of the flooring block body 11*c*, and the upper surface of the second mounting edge portion 112, 112*c* shares the same plane with the bottom surface of the flooring block body 11*c*.

As shown in FIG. 1 and FIG. 2, the mounting member 121 of the first mounting edge portion 111 is disposed on the upper surface of the first mounting edge portion 111. The mounting member 122 of the second mounting edge portion 112 is disposed on the bottom surface of the second mounting edge portion 112. In this embodiment, the mounting member 121 of the first mounting edge portion 111 includes a concave bar extending in a direction along the first mounting edge portion, and the mounting member 122 of the second mounting edge portion 112 includes a protrusive bar whose shape complements the concave bar. As shown in FIG. 3, by means of inserting the protrusive bar of the mounting member 122 of the second mounting edge portion 112 into the concave bar of the first mounting edge portion 121*a* of another flooring block body 11*a*, the mounting member 122 of the second mounting edge portion 112 is mounted to the mounting member 121*a* of the first mounting edge portion 111*a*. Similarly, a protrusive bar of another flooring block body can be inserted into the concave bar of the mounting member 121 of the first mounting edge portion 111, which is not shown in the figures. Certainly, the present invention is not limited to this. In other embodiments, the structures inside the mounting member of the first mounting edge portion and that of the second mounting edge portion can be exchanged, that is, the mounting member of the first mounting edge portion includes a protrusive bar and the mounting member of the second mounting edge portion includes a concave bar. As another option, the mounting member of the first mounting edge portion and that of the second mounting edge portion can include other structures complementary to each other.

Figure 5:
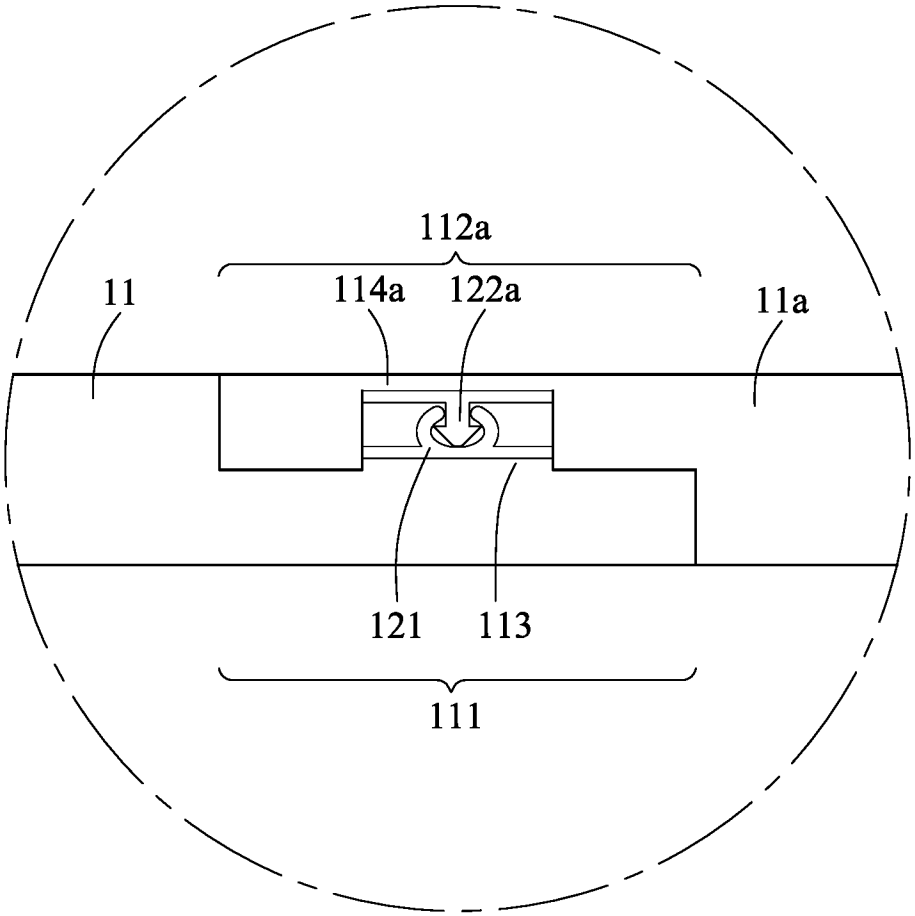
FIG. 5 is a side view illustrating the flooring block mounted to another adjacent flooring block according to another embodiment of the present invention.

As shown in FIG. 5, the first mounting edge portion 111 further includes a concave-convex structure 113 on which the mounting member 121 is disposed. In this embodiment, the concave-convex structure 113 is a convex element. Furthermore, the second mounting edge portion 112*a* of said another flooring block body 11*a* includes a complementary concave-convex structure 114*a* that matches the concave-convex structure. In this embodiment, the complementary concave-convex structure 114*a* is a concave element on which the mounting member 112*a* of said another flooring block body 11*a* is disposed. By the above-mentioned structural means, when the flooring bock body 11 is mounted to said another flooring block body 11*a*, not only the mounting member 121 and the mounting member 122*a* can fit together, but also the concave-convex structure 113 and the complementary concave-convex structure 114*a* will fit together besides Via the technical means adopted by the present invention, the flooring block of the present invention can be mounted with or be dismounted from an adjacent flooring block by applying a force from up to down or from down to up. Thus, as compared with the flooring blocks of prior art, which requires consideration of enough space for flooring blocks to slide in or slide out when installing the flooring, the flooring blocks of the present invention are free from this restriction since they can be mounted to and dismounted from one another conveniently in the up-and-down direction. On the other hand, a flooring block of the present invention can be mounted to and dismounted from another flooring block without having to adjust the positions of other flooring blocks. By this structural means, the replacement, rearrangement, and positions adjustments of the flooring block of the present invention can be processed quickly and simply.

The above description is only an explanation of the preferred embodiments of the present invention. A person with ordinary skill in the art can make various modifications according to the above description and the claims defined below. However, those modifications shall still fall within the scope of the present invention.

What is claimed is:

1. A dismountable flooring block, comprising:

a flooring block body having a first mounting edge portion and a second mounting edge portion, the first mounting edge portion and the second mounting edge portion being thinner than the flooring block body and being laterally extended from the flooring block body, the first mounting edge portion having an upper surface including a middle-upper surface and two side-upper surfaces neighboring to both sides of the middle-upper surface, the second mounting edge portion having a bottom surface including a middle-bottom surface and two side-bottom surfaces neighboring to both sides of the middle-bottom surface, wherein the middle-upper surface, the two side-upper surfaces, the middle-bottom surface and the two side-bottom surfaces are flat surfaces perpendicular to an up-and-down direction of the flooring block body, the middle-upper surface and each side-upper surface are positioned at different height levels in the up-and-down direction, and the middle-bottom surface and each side-bottom surface are positioned at different height levels in the up-and-down direction; and two mounting members, which are structurally independent from the flooring block body and are respectively disposed protruding from the middle-upper surface of the first mounting edge portion and from the middle-bottom surface of the second mounting edge portion in the up-and-down direction, in which a mounting direction of the first mounting edge portion and a mounting direction of the second mounting edge portion are both parallel to the up-and-down direction of the flooring block body, thereby enabling the mounting member of the flooring block body to mount to a mounting member of another flooring block body, wherein the first mounting edge portion of the flooring block body overlaps in the mounting direction a second mounting edge portion of said another flooring block body which is neighboring to the first mounting edge portion of flooring block body, the two mounting members are provided to face and engage with each other in a straight line along the mounting direction, and the two side-upper surfaces of the first mounting edge portion are provided to contact two side-bottom surfaces of the second mounting edge portion of said another flooring block body in such a manner that the first mounting edge portion of the flooring block body is mounted to the second mounting edge portion of said another flooring block such that the flooring block body is mounted to said another flooring block neighboring to the flooring block body in a direction perpendicular to the up-and-down direction.

2. The dismountable flooring block as claimed in claim 1, wherein the first mounting edge portion and the second mounting edge portion are provided on opposite sides of the flooring block body.

3. The dismountable flooring block as claimed in claim 1, wherein the mounting member of the first mounting edge portion includes a protrusive bar extending in a direction along the first mounting edge portion, and the mounting member of the second mounting edge portion includes a concave bar, and by means of inserting the protrusive bar of the flooring block into the concave bar, the mounting member of the first mounting edge portion is mounted to the mounting member of the second mounting edge portion of said another flooring block body.

4. The dismountable flooring block as claimed in claim 1, wherein the mounting member of the first mounting edge portion includes a concave bar extending in a direction along the first mounting edge portion, and the mounting member of the second mounting edge portion includes a protrusive bar, and by means of inserting the protrusive bar into the concave element, the mounting member of the first mounting edge portion is mounted to the mounting member of the mounting edge portion of said another flooring block body.

5. The dismountable flooring block as claimed in claim 1, wherein the first mounting edge portion or the second mounting edge portion of the flooring board block includes a concave-convex structure on which the mounting member is disposed.

6. The dismountable flooring block as claimed in claim 1, wherein the first mounting edge portion or the second mounting edge portion of the flooring board block includes a concave-convex structure on which the mounting member is disposed, and the second mounting edge portion or a first mounting edge portion of said another flooring block body includes a complementary concave-convex structure that matches the concave-convex structure.

* * * * *